United States Patent [19]

Imai et al.

[11] Patent Number: 5,015,999

[45] Date of Patent: May 14, 1991

[54] DISPLAY UNIT

[75] Inventors: Kunio Imai; Hitoshi Nakada, both of Saitama, Japan

[73] Assignee: Pioneer Electronic Corporation, Tokyo, Japan

[21] Appl. No.: 293,280

[22] Filed: Jan. 4, 1989

[30] Foreign Application Priority Data

Jul. 27, 1988 [JP] Japan ..... 63-187391

[51] Int. Cl.[5] ..... G09G 3/22

[52] U.S. Cl. ..... 340/702; 340/760; 340/766

[58] Field of Search ..... 340/772, 781, 780, 702, 340/760, 766; 315/169.3; 313/498, 499, 500, 505, 501, 503

[56] References Cited

U.S. PATENT DOCUMENTS

| | | | |
|---|---|---|---|
| 4,162,427 | 7/1979 | Kamegaya et al. | 340/772 |
| 4,668,049 | 5/1987 | Canter et al. | 350/345 |
| 4,678,285 | 7/1987 | Ohta et al. | 350/345 |
| 4,720,432 | 1/1988 | VanSlyke et al. | 313/498 |

*Primary Examiner*—Jeffery A. Brier

*Attorney, Agent, or Firm*—Finnegan, Henderson, Farabow, Garrett, and Dunner

[57] ABSTRACT

A display unit for displaying two-dimensional images and pictures comprises a fluorescent layer which fluoresces when irradiated with ultraviolet light and an electric-field ultraviolet light generating device provided behind the fluorescent layer for selective irradiation of the fluorescent layer. The fluorescent layer comprises different types of fluorescent material which emit different colors. The electric-field ultraviolet light generating device comprises a positive electrode layer, a positive hole injection layer, a light emission layer, and a negative electrode layer, respectively.

6 Claims, 1 Drawing Sheet

DISPLAY UNIT

BACKGROUND OF THE INVENTION

1. Field of the Invention

The present invention is directed generally to a display unit and more specifically is directed to a display unit suitable for use in displaying two-dimensional picture displays.

2. Description of Related Art

Cathode ray tube screens (CRT screens) and liquid crystal display screens (LCD screens) are currently widely used as display units. Although both types of screens are generally considered effective for use as display units, neither type of screen is completely free from certain disadvantages and drawbacks.

CRT screens require a vacuum tube system and, therefore, suffer from certain disadvantages associated with vacuum tubes in general. For example, vacuum tubes require a certain amount of depth in order to properly operate and, therefore, it is difficult to make a flat CRT screen. Additionally, the size of the CRT screen is also limited by the necessity of a vacuum tube system. Furthermore, CRT screens require high electrical voltage in order to operate.

One of the disadvantages of LCD screens are related to nonuniformity in screen brightness due to slow response to display drive signals. LCD screens also suffer from the drawback of being dependent on optical orientation and require a line of view that is fairly normal to the plane of the LCD screen. Additionally, LCD screens suffer from poor transmission efficiency.

SUMMARY OF THE INVENTION

An object of the present invention is a display unit that does not suffer from the drawbacks and disadvantages of CRT and LCD screens.

Another object of the present invention is a display unit that is lightweight and that can be made to have a large, flat screen.

A further object of the present invention is a display unit that is not dependent on optical orientation of the screen for viewing the display unit screen image.

Additional objects and advantages of the present invention will be set forth, in part, in the description which follows and, in part, will be obvious from the description or may be learned by practice of the invention. The objects and advantages of the invention may be learned by and attained by means of the instrumentalities and combination of steps particularly pointed out in the appended claims.

To achieve the foregoing objects and in accordance with the purpose of the present invention, as embodied and broadly described herein, the display unit of the present invention comprises a fluorescent layer that emits light when irradiated with ultraviolet rays and an electric-field ultraviolet light emitting device provided behind the fluorescent layer to selectively irradiate the fluorescent layer. The fluorescent layer comprises three different types of fluorescent material which emit red, green, and blue light respectively and which are arranged in narrow strips in consecutive and repeating sequence. The electric-field ultraviolet light emitting device comprises a positive electrode layer, a positive hole injection layer, a light emission layer, and a negative electrode layer, respectively.

The accompanying drawings, which are incorporated in and constitute a part of this specification, illustrate one embodiment of the present invention and, together with the description, serve to explain the principles of the present invention.

DESCRIPTION OF THE PREFERRED EMBODIMENT

Figure 1:
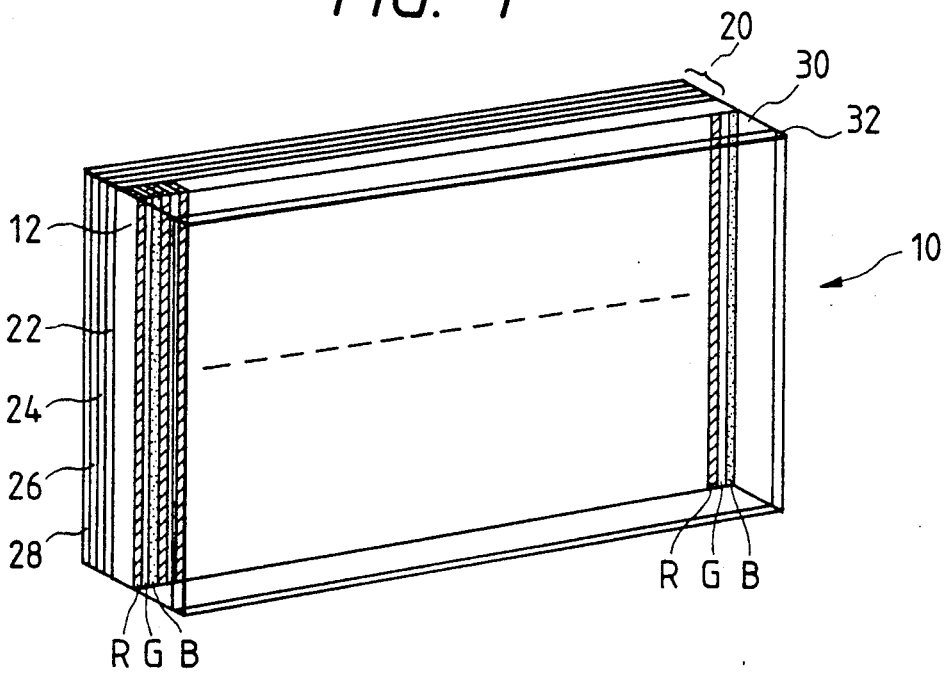
FIG. 1 is a schematic, perspective view of an embodiment of the display unit of the present invention.

Reference will now be made, in detail, to a preferred embodiment of the present invention, an example of which is illustrated in the accompanying drawings and is represented generally by the reference numeral 10. Whenever possible, the same reference numbers will be used throughout the drawings to refer to the same or like parts.

Figure 2:
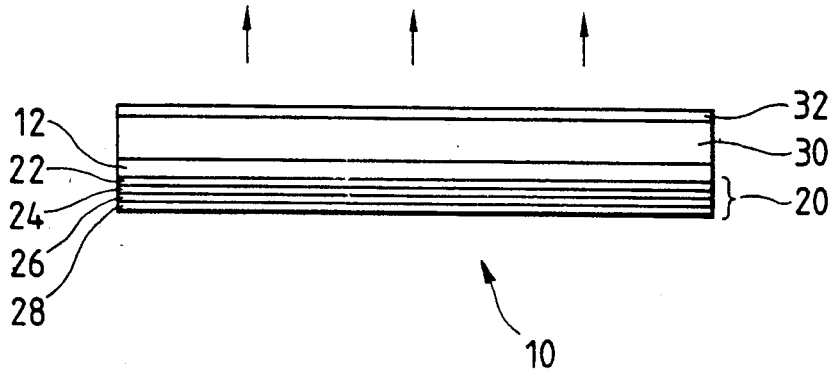
FIG. 2 is a cross-sectional, plan view thereof.

Referring to FIGS. 1 and 2 and in accordance with the present invention, it may be seen that a fluorescent layer 12 is provided for emitting light in response to ultraviolet rays, especially in response to black light having a wavelength of approximately 365 nanometers. The thickness of the fluorescent layer is on the order of from approximately 1000 to 5000 angstroms.

The fluorescent layer 12 comprises three different types of fluorescent material, a first type (R) that emits red light, a second type (G) that emits green light, and a third type (B) that emits blue light, respectively. Each type of fluorescent material R, G, B is disposed in the fluorescent layer as narrow stripes arranged in a repeating sequence of R, G, and B. Suitable fluorescent materials may be obtained from, for example, Sinloihi Co., Ltd. (Japan) under the tradename LUMILITE COLOR. LUMILITE COLOR fluorescent materials that emit red light (R) comprise the yttrium oxide series. Those that emit green light (G) are of the zinc oxide or germanium oxide series, and those that emit blue light (B) are of the boron calcium oxide series.

An electric-field light emission device 20 that emits ultraviolet light is provided behind the fluorescent layer 12 to selectively irradiate the fluorescent layer 12. The electric-field light emission device 20 comprises a positive electrode layer 22, a positive hole injection layer 24, a light emission layer 26, and a negative electrode layer 28, respectively, in a stacked face-to-face configuration.

The light emission layer 26 comprises a fluorescence whitening agent for emitting ultraviolet light having a wavelength on the order of approximately 365 nanometers. Examples of materials suitable for use in the light emission layer 26 for emission of ultraviolet light having a wavelength in a range from approximately 350 nanometers to 375 nanometers include p-terphenyl; 2,2″-dimethyl-p-terphenyl; p-quarterphenyl; 3,3′,2″,3‴- tetramethyl-p-quarterphenyl; and 4,4″-bis-butyloctyloxy-quarterphenyl.

The thickness of each layer of the electric-field light emission device 20, i.e., the positive electrode layer 22, positive hole injection layer 24, light emission layer 26, and negative electrode layer 28, is on the order of approximately 1000 angstroms.

The positive electrode layer 22 comprises a plurality of thin conductive strips that extend horizontally in parallel configuration relative to each other. The negative electrode layer 28 comprises a plurality of thin conductive strips that extend vertically in parallel configuration relative to each other. The points at which each positive and negative conductive strip intersect corresponds to a single picture element or a pixel. Horizontal scanning is performed by selectively applying electrical power to each successive conductive strip across the positive electrode layer 22, and vertical scanning is performed by selectively applying electrical power to each successive conductive strip across the negative electrode layer 28. Selective application of electrical power to the electrode layers may be achieved by the use of electrical circuits. By using a fluorescent layer 12 having memory properties, the electrical circuits required for driving the light emission layer 26 may be simplified. It is to be understood that the shape of each electrode layer 22 and 28 may be modified and altered in accordance with the shape of the region from which light is to be emitted per unit time, i.e., the shape of the display screen.

A glass plate 30 having a thickness on the order of approximately 2 μm is provided in front of the fluorescent layer 12 where light is emitted, and an ultraviolet blocking layer 32 having a thickness on the order of approximately 1000 angstroms is provided in front of the glass plate 30. The ultraviolet blocking layer 32 comprises an ultraviolet blocking film or glass plate or an ultraviolet absorbing film or glass plate, shields the fluorescent layer 12 from external light, and prevents ultraviolet light emitted from the electric-field light emission device 20 from leaking out through the fluorescent layer 12 and glass plate 30.

In the display unit of the present invention, the fluorescent layer 12, comprises sequentially disposed narrow strips of fluorescent materials R, G and B which emit light upon exposure to ultraviolet light. The layer 12 is provided as a faceplate juxtaposed with the electric-field light emission device 20 to allow pixel by pixel irradiation of the fluorescent layer 12 with ultraviolet light emitted by the electric-field light emission device 20. Accordingly, the display unit of the present invention, unlike LCD screens, is not dependent on optical orientation. Additionally, the display unit of the present invention is capable of display speeds, i.e., screen scanning frequencies, sufficient for displaying moving pictures and motion graphics.

As noted previously, the thickness of the fluorescent layer 12 is on the order of from approximately 1000 to 5000 angstroms, and the thickness of each layer of the electric-field light emission device 20 is on the order of approximately 1000 angstroms. Accordingly, it is not difficult to make large-scale screens that are flat and relatively lightweight.

It will be apparent to those skilled in the art that various modifications and variations can be made in the method and apparatus of the present invention without departing from the scope or spirit of the invention. Thus, it is intended that the present invention cover such modifications and variations of this invention provided they come within the scope of the appended claims and their equivalents.

What is claimed is:

1. A display unit for displaying two-dimensional images comprising:

a fluorescent layer for emitting light when exposed to ultraviolet rays, said fluorescent layer including three different types of fluorescent material arranged in narrow strips in consecutive and repeating sequences that emit red, green and blue light, respectively, said fluorescent layer further having a thickness on the order of from approximately 1000 to 5000 angstroms; and an electric-field ultraviolet light emitting device having a positive electrode layer, a positive hole injection layer, a light emission layer, and a negative electrode layer, respectively, in a stacked face-to-face configuration, provided integrally behind said fluorescent layer for selective irradiation of said fluorescent layer.

2. A display unit as claimed in claim 1, wherein a glass plate is provided in front of said fluorescent layer.

3. A display unit as claimed in claim 2, wherein an ultraviolet light blocking layer is provided in front of said glass plate.

4. A display unit as claimed in claim 1, wherein said electric-field ultraviolet emitting device emits ultraviolet light having a wavelength in a range from approximately 350 nanometers to 375 nanometers.

5. A display unit as claimed in claim 1, wherein said light emission layer is made from a material selected from the group consisting of p-terphenyl; 2,2Δ-dimethyl-p-terphenyl; p-quarterphenyl; 3,3', 2'', 3'''-tetramethyl-p-quarterphenyl; and 4,4''-bis-butyloctyloxy-quarterphenyl.

6. A display unit as claimed in claim 1, wherein the thickness of each of said positive hole injection layer, light emission layer and negative electrode layer is approximately on the order of 1000 angstroms.

* * * * *

UNITED STATES PATENT AND TRADEMARK OFFICE

CERTIFICATE OF CORRECTION

PATENT NO. : 5,015,999

DATED : May 14, 1991

INVENTOR(S) : Kunio Imai et al.

It is certified that error appears in the above-identified patent and that said Letters Patent is hereby corrected as shown below:

Claim 5, column 4, line 41, change "2A" to --2"--.

Signed and Sealed this

Twenty-third Day of February, 1993

*Attest:*

STEPHEN G. KUNIN

*Attesting Officer*

*Acting Commissioner of Patents and Trademarks*